US008872492B2

(12) United States Patent
Zhang et al.

(10) Patent No.: US 8,872,492 B2
(45) Date of Patent: Oct. 28, 2014

(54) ON-CHIP LOW VOLTAGE CAPACITOR-LESS LOW DROPOUT REGULATOR WITH Q-CONTROL

(75) Inventors: Junmou Zhang, Chandler, AZ (US); Lew G. Chua-Eoan, Carlsbad, CA (US)

(73) Assignee: QUALCOMM Incorporated, San Diego, CA (US)

( * ) Notice: Subject to any disclaimer, the term of this patent is extended or adjusted under 35 U.S.C. 154(b) by 637 days.

(21) Appl. No.: 13/091,715

(22) Filed: Apr. 21, 2011

(65) Prior Publication Data

US 2011/0267017 A1 Nov. 3, 2011

Related U.S. Application Data

(60) Provisional application No. 61/329,141, filed on Apr. 29, 2010.

(51) Int. Cl.
*G05F 1/40* (2006.01)
*G05F 1/575* (2006.01)

(52) U.S. Cl.
CPC ..... *G05F 1/575* (2013.01)
USPC ..... 323/280

(58) Field of Classification Search
CPC ..... G05F 1/575
USPC ..... 323/271, 273, 275, 280, 281
See application file for complete search history.

(56) References Cited

U.S. PATENT DOCUMENTS

| | | | | |
|---|---|---|---|---|
| 5,563,501 | A | 10/1996 | Chan | |
| 6,130,569 | A | 10/2000 | Aswell et al. | |
| 6,246,221 | B1 | 6/2001 | Xi | |
| 6,856,124 | B2 * | 2/2005 | Dearn et al. | 323/280 |
| 6,977,490 | B1 | 12/2005 | Zhang et al. | |
| 8,154,263 | B1 * | 4/2012 | Shi et al. | 323/269 |
| 2003/0111986 | A1 | 6/2003 | Xi et al. | |
| 2008/0157735 | A1 | 7/2008 | Liu et al. | |
| 2009/0001953 | A1 | 1/2009 | Huang | |

FOREIGN PATENT DOCUMENTS

| | | | |
|---|---|---|---|
| CN | 101464699 | A | 6/2009 |
| KR | 20070102421 | A | 10/2007 |
| TW | 200825651 | A | 6/2008 |
| TW | 201033782 | A | 9/2010 |

OTHER PUBLICATIONS

International Search Report and Written Opinion—PCT/US2011/034067—ISA/EPO—Nov. 4, 2011.

S.K. Lau, P.K.T. Mok, K.N. Leung, "A low-dropout regulator for SoC with Q-reduction", IEEE Journal of Solid-State Circuits, vol. 42, No. 3, Mar. 2007.

(Continued)

*Primary Examiner* — Matthew Nguyen
(74) *Attorney, Agent, or Firm* — Donald D. Min

(57) ABSTRACT

Systems and method for a capacitor-less Low Dropout (LDO) voltage regulator. An error amplifier is configured to amplify a differential between a reference voltage and a regulated LDO voltage. Without including an external capacitor in the LDO voltage regulator, a Miller amplifier is coupled to an output of the error amplifier, wherein the Miller amplifier is configured to amplify a Miller capacitance formed at an input node of the Miller amplifier. A capacitor coupled to the output of the error amplifier creates a positive feedback loop for decreasing a quality factor (Q), such that system stability is improved.

32 Claims, 6 Drawing Sheets

(56) References Cited

OTHER PUBLICATIONS

K. N. Leung and P. K. T. Mok, "A capacitor-free CMOS low-dropout regulator with damping-factor-control frequency compensation," IEEE J. Solid-State Circuits, vol. 38, No. 10, pp. 1691-1702, Oct. 2003.

R.J. Milliken, J. Silva-Martinez, E. Sanchez-Sinencio, "Full on-chip CMOS low-dropout voltage regulator", IEEE Transactions on Circuits and Systems I: Fundamental Theory and Applications, vol. 54, No. 9, Sep. 2007, pp. 1879-1890.

Rincon-Mora, G.A.; Active capacitor multiplier in Miller-compensated circuits, Solid-State Circuits, IEEE Journal of vol. 35, Issue 1, Jan. 2000 pp. 26-32.

Zushu Yan; Yuanfu Zhao; Yuaniu Zhao; "Fregency Compensation for Multistage Amplifiers using Active-Feedback Current Buffers", Electrical and Computer Engineering, Canadian Conference on May 2006 pp. 1710-1714.

Joao Ramos; Steyaert, M.S.J., Positive feedback frequency compensation for low-voltage low-power three-stage amplifier, Circuits and Systems I: Regular Papers, IEEE Transactions on [see also Circuits and Systems I: Fundamental Theory and Applications, IEEE Transactions on] vol. 51, Issue 10, Oct. 2004 pp. 1967-1974 Digital Object Identifier 10.1109/TCSI.2004.835662.

Taiwan Search Report—TW100115236—TIPO—Jan. 8, 2014.

* cited by examiner

PRIOR ART
Conventional LDO Voltage Regulator

ON-CHIP LOW VOLTAGE CAPACITOR-LESS LOW DROPOUT REGULATOR WITH Q-CONTROL

CLAIM OF PRIORITY UNDER 35 U.S.C. §119

The present Application for Patent claims priority to Provisional Application No. 61/329,141 entitled "On-Chip Low Voltage Capacitor-Less Low Dropout Regulator with Q-Control" filed Apr. 29, 2010, and assigned to the assignee hereof and hereby expressly incorporated by reference herein.

FIELD OF DISCLOSURE

Disclosed embodiments are directed to capacitor-less implementations of low dropout (LDO) on-chip voltage regulators. More particularly, exemplary embodiments are directed to capacitor-less implementations of LDO voltage regulators configured to control quality factor (Q), thus improving system stability.

BACKGROUND

Power management plays an important role in the current day electronics industry. Battery powered and handheld devices require power management techniques to extend battery life and improve the performance and operation of the devices. One aspect of power management includes controlling operational voltages. Conventional electronic systems, particularly systems on-chip (SOCs) commonly include various subsystems. The various subsystems may be operated under different operational voltages tailored to the specific needs of the subsystems. Voltage regulators are employed to deliver specified voltages to the various subsystems. Voltage regulators may also be employed to keep the subsystems isolated from one another.

Low dropout (LDO) voltage regulators are commonly used to generate and supply low voltages, and achieve low-noise circuitry. Conventional LDO voltage regulators require a large external capacitor, frequently in the range of a several microfarads. These external capacitors occupy valuable board space, increase the integrated circuit (IC) pin count, and prevent efficient SOC solutions.

With reference to FIG. 1, a conventional LDO voltage regulator 100 with capacitor $C_L$ is illustrated. Capacitor $C_L$ is problematic, as discussed above. As illustrated, LDO voltage regulator 100 accepts an unregulated input voltage $V_{in}$ and an input reference voltage $V_{ref}$, and generates a regulated output voltage $V_{out}$. One input of differential amplifier 102 monitors a fraction of regulated output voltage $V_{out}$, as determined by the resistance ratio of resistors $R_1$ and $R_2$. The other input to differential amplifier 102 is stable, reference voltage $V_{ref}$. The output of differential amplifier 102 drives a large pass transistor, transistor 104. If regulated output voltage $V_{out}$, which is derived at the output of transistor 104 rises too high relative to reference voltage $V_{ref}$, then differential amplifier 102 alters the drive strength to transistor 104 in order to maintain regulated output voltage $V_{out}$ at a constant voltage value.

Conventional LDO voltage regulator 100 of FIG. 1 is a "two pole" system. A "pole," as is well known in control systems associated with electrical circuits is an indication of stability of the electrical circuit. Specifically, with respect to resistor-capacitor circuits, a loop gain plotted over a range of frequencies of the alternating current passing through the circuit would increase dramatically at the poles of the circuit. In order to maintain stability of the circuit at these poles, the poles are compensated with other circuit elements which act as damping factors on the loop gain. If multiple poles exist, for example, due to multiple resistor-capacitor combinations, focus may be placed on compensating the dominant pole. In such systems, it is desirable that a non-dominant pole lies close to the dominant pole, such that compensation circuits may be effectively employed in stabilizing both the dominant and the non-dominant pole.

Returning to FIG. 1, a non-dominant pole is formed at the gate of transistor 104. Capacitor $C_L$ contributes to the dominant pole. In order to achieve system stability, resistor $R_{ESR}$ is introduced as shown. However, it is extremely difficult to control $R_{ESR}$ with sufficient precision in order to ensure stability of LDO voltage regulator 100 over both poles. Therefore, as an alternative, the size of capacitor $C_L$ is increased, sometimes to the order of several microfarads, which leads to the numerous above-described problems. Accordingly, there arises in the art for solutions which do not require a large capacitor $C_L$ for establishing stability of LDO voltage regulator 100. In other words, there is a need for capacitor-less solutions of LDO voltage regulators.

Prior efforts to eliminate the capacitor from LDO voltage regulators suffer from severe drawbacks. For example, a damping factor control (DFC) block is utilized in K. N. Leung and P. K. T. Mok, "A capacitor - free CMOS low - dropout regulator with damping - factor - control frequency compensation ", IEEE J. Solid-State Circuits, vol. 38, no. 10, pp. 1691-1702, October 2003 (hereinafter, "Leung"). However, the DFC block of Leung is essentially an amplifier which includes a capacitor to boost the capacitive load at the output of the error amplifier. This capacitor creates a dominant pole. As a result, the technique of Leung requires a minimum of 1 mA current-load in order to ensure stability of the LDO voltage regulator. Supporting such large current-loads, in the order of several mAs is not feasible. Thus, Leung's LDO voltage regulator is not suitable for efficient SOC implementations.

In another example, a quality factor (Q) reduction technique is proposed in S. K. Lau, P. K. T. Mok, K. N. Leung, "A low - dropout regulator for SoC with Q - reduction ", IEEE Journal of Solid-State Circuits, Vol. 42, No.3, March 2007 (hereinafter, "Lau"). Lau's technique includes a capacitor and a diode to control the peak gain of the LDO voltage regulator. However, Lau's technique also suffers from the drawback of requiring a very large minimum current load, in the order of 100 uA, in order to maintain stability of the LDO voltage regulator.

Yet another example of an LDO voltage regulator is described in R. J. Milliken, J. Silva-Martinez, E. Sanchez-Sinencio, "Full on-chip CMOS low-dropout voltage regulator ", IEEE Transactions on Circuits and Systems I: Fundamental Theory and Applications, Vol. 54, No. 9, September 2007, Pages: 1879-1890 (hereinafter, "Milliken"). Milliken utilizes a differentiator loop to sense changes in the output voltage of the LDO voltage regulator, and provides a fast negative feedback path for load transients. The differentiator loop also acts as a "Miller capacitor" to stabilize the LDO voltage regulator, by splitting the poles of the circuit. Milliken uses a "cascode" current mirror to guarantee proper current distribution at the gate of the pass transistor. However, a proper current distribution is difficult to maintain at the low power supply voltages and the shrinking device sizes that are common trends in the art. Lack of proper current distribution could result in a large current offset. Moreover, Milliken's technique to control peak gain of the LDO voltage regulator requires a large number of iterations to achieve convergence.

Yet another LDO implementation is seen in Texas Instrument's product, "TPS73601." The TPS73601 is a standalone implementation of an LDO voltage regulator, which includes a charge pump and a "servo" block to speed up voltage changes at the gate of the pass transistor. The servo block uses a comparator to measure output voltage. When the output voltage is lower than a specified voltage, i.e. if there is an "undershoot," a sourcing current will be increased. On the other hand, if an overshoot occurs, a sinking current will be increased. Implementation of the TPS73601 requires additional circuitry which consumes a large quiescent current, and consequently is not power efficient.

Accordingly, there exists a need in the art for efficient capacitor-less solutions for LDO voltage regulators, which are not burdened by the drawbacks of above described techniques.

SUMMARY

Exemplary embodiments of the invention are directed to systems and method for capacitor-less implementations of LDO voltage regulators.

For example, an exemplary embodiment is directed to a capacitor-less Low Dropout (LDO) voltage regulator comprising: an error amplifier configured to amplify a differential between a reference voltage and a regulated LDO voltage, and a Miller amplifier coupled to an output of the error amplifier, wherein the Miller amplifier is configured to amplify a Miller capacitance formed at an input node of the Miller amplifier. A capacitor coupled to the output of the error amplifier creates a positive feedback loop for decreasing a quality factor (Q), such that system stability is improved.

Another exemplary embodiment is directed to a method for forming a capacitor-less Low Dropout (LDO) voltage regulator comprising: configuring an error amplifier to amplify a differential between a reference voltage and a regulated LDO voltage, coupling a Miller amplifier to an output of the error amplifier, and configuring the Miller amplifier to amplify a Miller capacitance formed at an input node of the Miller amplifier.

Yet another exemplary embodiment is directed to a method for forming a capacitor-less Low Dropout (LDO) voltage regulator comprising step for configuring an error amplifier to amplify a differential between a reference voltage and a regulated LDO voltage, step for coupling a Miller amplifier to an output of the error amplifier, and step for configuring the Miller amplifier to amplify a Miller capacitance formed at an input node of the Miller amplifier.

A further exemplary embodiment is directed to a system comprising a capacitor-less Low Dropout (LDO) voltage regulator, wherein the LDO voltage regulator comprises: an amplifier means to amplify a differential between a reference voltage and a regulated LDO voltage, and a Miller amplifier coupled to an output of the amplifier means, wherein the Miller amplifier is configured to amplify a Miller capacitance formed at an input node of the Miller amplifier.

BRIEF DESCRIPTION OF THE DRAWINGS

The accompanying drawings are presented to aid in the description of embodiments of the invention and are provided solely for illustration of the embodiments and not limitation thereof.

DETAILED DESCRIPTION

Figure 1:
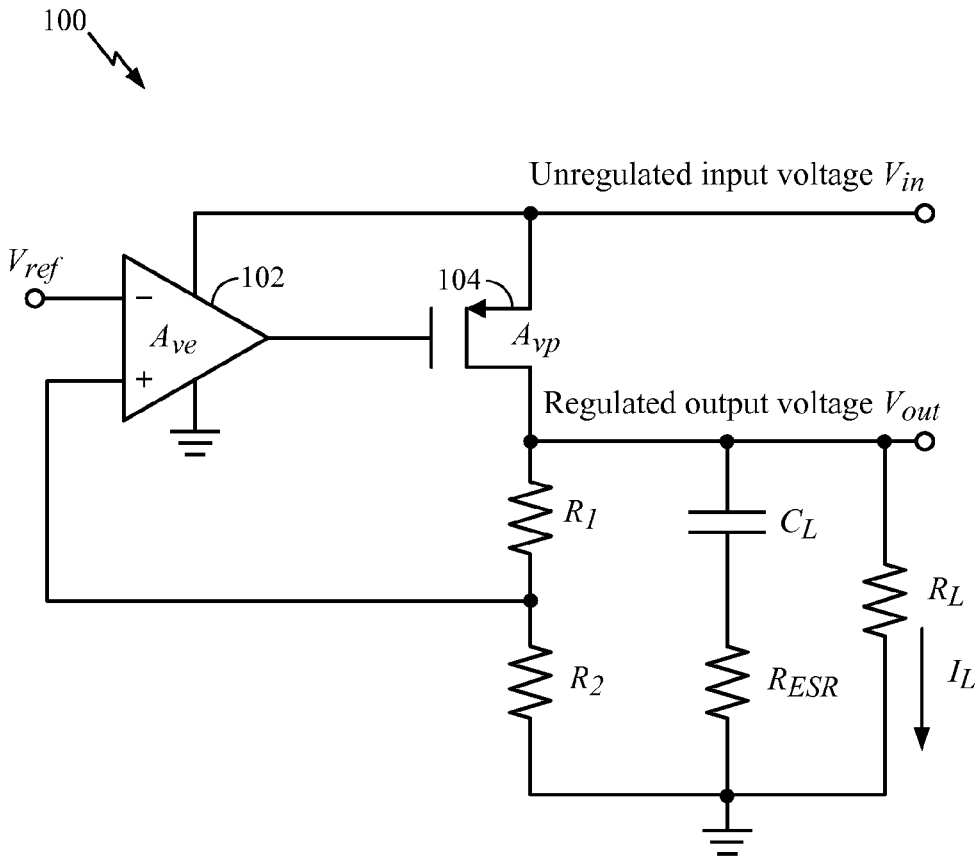
FIG. 1 illustrates a conventional LDO voltage regulator.

Aspects of the invention are disclosed in the following description and related drawings directed to specific embodiments of the invention. Alternate embodiments may be devised without departing from the scope of the invention. Additionally, well-known elements of the invention will not be described in detail or will be omitted so as not to obscure the relevant details of the invention.

The word "exemplary" is used herein to mean "serving as an example, instance, or illustration." Any embodiment described herein as "exemplary" is not necessarily to be construed as preferred or advantageous over other embodiments. Likewise, the term "embodiments of the invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof Further, many embodiments are described in terms of sequences of actions to be performed by, for example, elements of a computing device. It will be recognized that various actions described herein can be performed by specific circuits (e.g., application specific integrated circuits (ASICs)), by program instructions being executed by one or more processors, or by a combination of both. Additionally, these sequence of actions described herein can be considered to be embodied entirely within any form of computer readable storage medium having stored therein a corresponding set of computer instructions that upon execution would cause an associated processor to perform the functionality described herein. Thus, the various aspects of the invention may be embodied in a number of different forms, all of which have been contemplated to be within the scope of the claimed subject matter. In addition, for each of the embodiments described herein, the corresponding form of any such embodiments may be described herein as, for example, "logic configured to" perform the described action.

Exemplary embodiments avoid large external capacitors in circuits for LDO voltage regulators by harvesting the Miller capacitance of the circuits. In general, a Miller capacitance results from a Miller effect—an increase in equivalent input capacitance of an amplifier due to amplification of capacitance between input and output terminals of the amplifier. Specifically with reference to LDO voltage regulators, the Miller capacitance realized between input and output terminals of circuits implementing LDO voltage regulators, are boosted by one or more amplification stages in order to provide a stable implementation of the circuit, without the need for large external capacitors.

Figure 2:
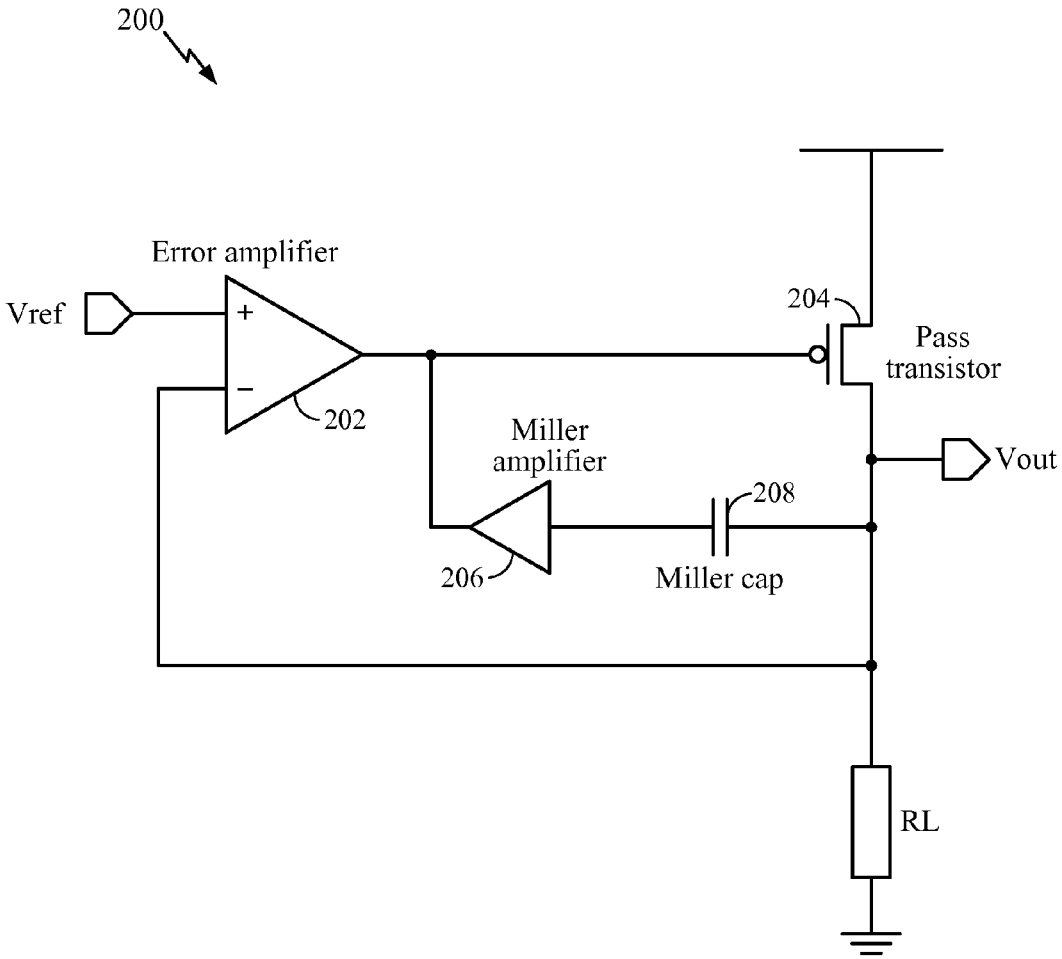
FIG. 2 is a schematic representation of an exemplary capacitor-less LDO voltage regulator.

Referring now to FIG. 2 a schematic representation of LDO voltage regulator 200 is illustrated. In contrast to conventional LDO voltage regulator 100 of FIG. 1, LDO voltage regulator 200 does not require a large capacitor $C_L$ to achieve circuit stability. Instead the circuit topology merges an amplified value of Miller capacitor 208 using Miller amplifier 206 with the output of error amplifier 202, at the gate terminal of pass transistor 204.

Figure 3:
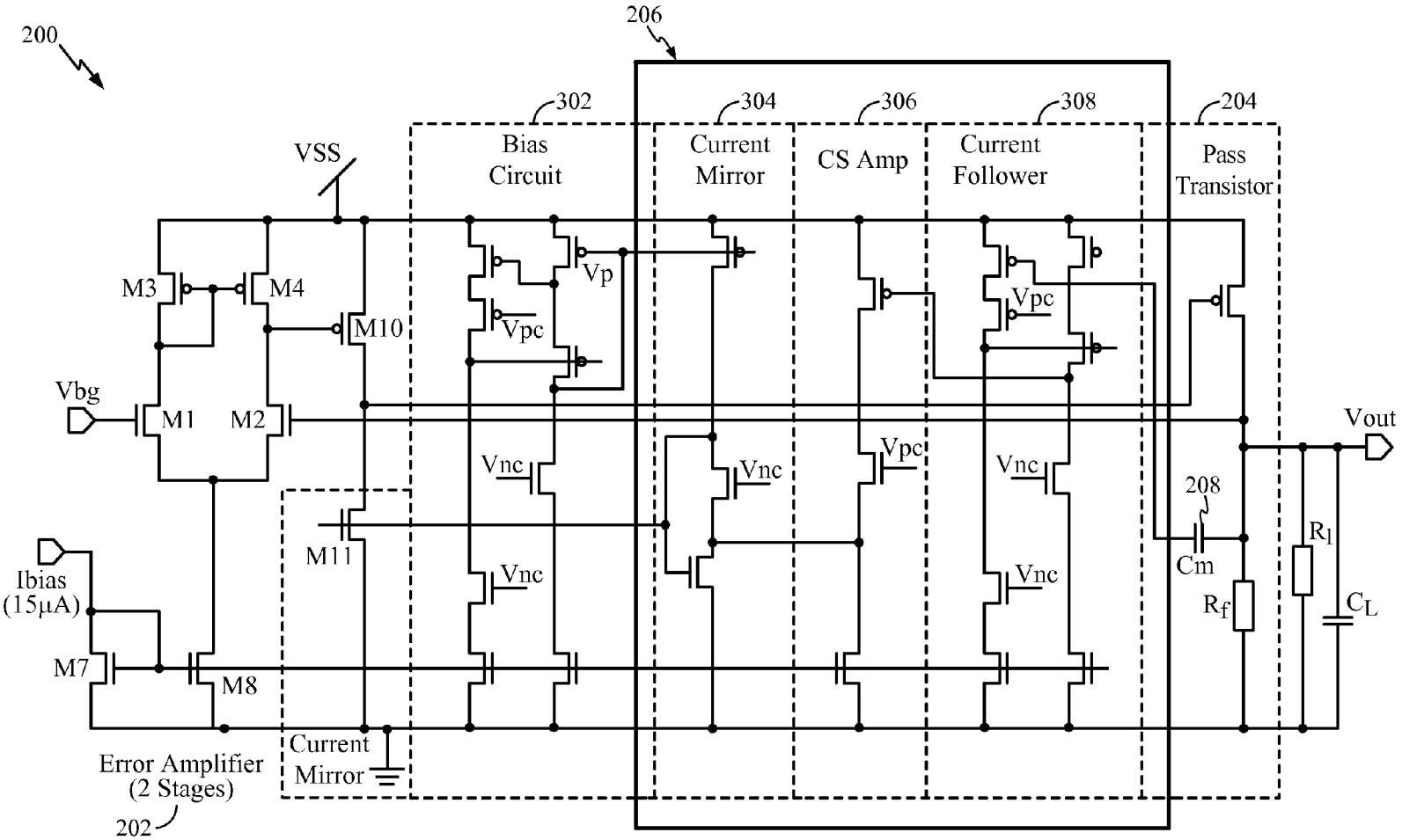
FIG. 3 illustrates a circuit diagram of an exemplary capacitor-less LDO voltage regulator.

With reference to FIG. 3, an exemplary circuit implementation of LDO voltage regulator 200 is illustrated. As illustrated in FIG. 3, a Bias Circuit 302, a Current Follower 308, a Current Source (CS) Amplifier 306, and Current Mirror 304 combinedly form Miller amplifier 206 configured to amplify Miller capacitor 208. Current Follower 308 essentially follows the current flowing through Miller capacitor 208. CS Amplifier 306 is a voltage amplifier which amplifies the voltage output at the output of Current Follower 308. Current Mirror 304, including transistor M11, then acts to translate the amplified voltage to an amplification of current. Bias Circuit 302 operates to bias the circuit of LDO voltage regulator 200 at a current value derived from external current supply Ibias, as shown in FIG. 3. Accordingly, the combination of Current Follower 308, CS Amplifier 306, and Current Mirror 304, effectively amplifies the current following through Miller capacitor 208, such that the current flowing through transistor M11 is amplified several orders of magnitude over the current flowing through Miller capacitor 208. It will be recognized that output capacitor $C_L$ can be maintained at a low value in the circuit of LDO voltage regulator 200, and does not need to be increased to a high value in order to ensure system stability.

With continuing reference to FIG. 3, transistors M1, M2, M3 and M4 are configured as a differential amplifier. In conjunction with transistors M7 and M8 configured as a current source, the transistor circuits comprising transistors M1, M2, M3, M4 and M7-M8 form two-stage error amplifier 202. Pass transistor 204 forms a third stage of error amplifier 202. The circuit of FIG. 3 ensures a regulated output voltage $V_{out}$ at the output of pass transistor 204.

With further reference to FIG. 3, a pull-up path comprising transistors M2 and M10 enable a pull up of output voltage $V_{out}$ to supply voltage VSS. A pull-down path comprising Miller amplifier 206 and transistor M11 enable a pull down of output voltage $V_{out}$ to ground voltage.

As previously described, the gain of an electrical system theoretically increases towards an infinite value at the poles of the system, rendering the system unstable. Accordingly, the electrical system can be designed to introduce damping elements to compensate for the uncontrolled gain at the poles. In like manner, the electrical system may be designed such that the peak gain value is disallowed from exceeding a specified value.

In the case of LDO voltage regulator 200, analyzing the "transfer function" or input/output characteristics over a spectrum of frequencies, reveals that peak gain can be controlled by controlling a quality factor (Q) of the circuit. Specifically, a smaller value of Q leads to a smaller peak gain value. By studying the transfer function over a range of frequencies, Quality factor Q is found to have an inversely proportional relationship with the effective current gain of Miller amplifier 206, hereinafter referred to as "gma"; and a directly proportional relationship with the effective current gain at the output load comprising resistance $R_L$ and capacitor $C_L$, hereinafter referred to as "gmp."

Accordingly, because a smaller Q leads to lower peak gain values, it is beneficial to maximize gma, which has the effect of lowering Q. Because gma is dependent on frequency, gma is required to be maximized over a wide bandwidth of frequencies. Exemplary embodiments implement a positive feedback technique to increase the bandwidth over which gma can be maximized.

Figure 4:
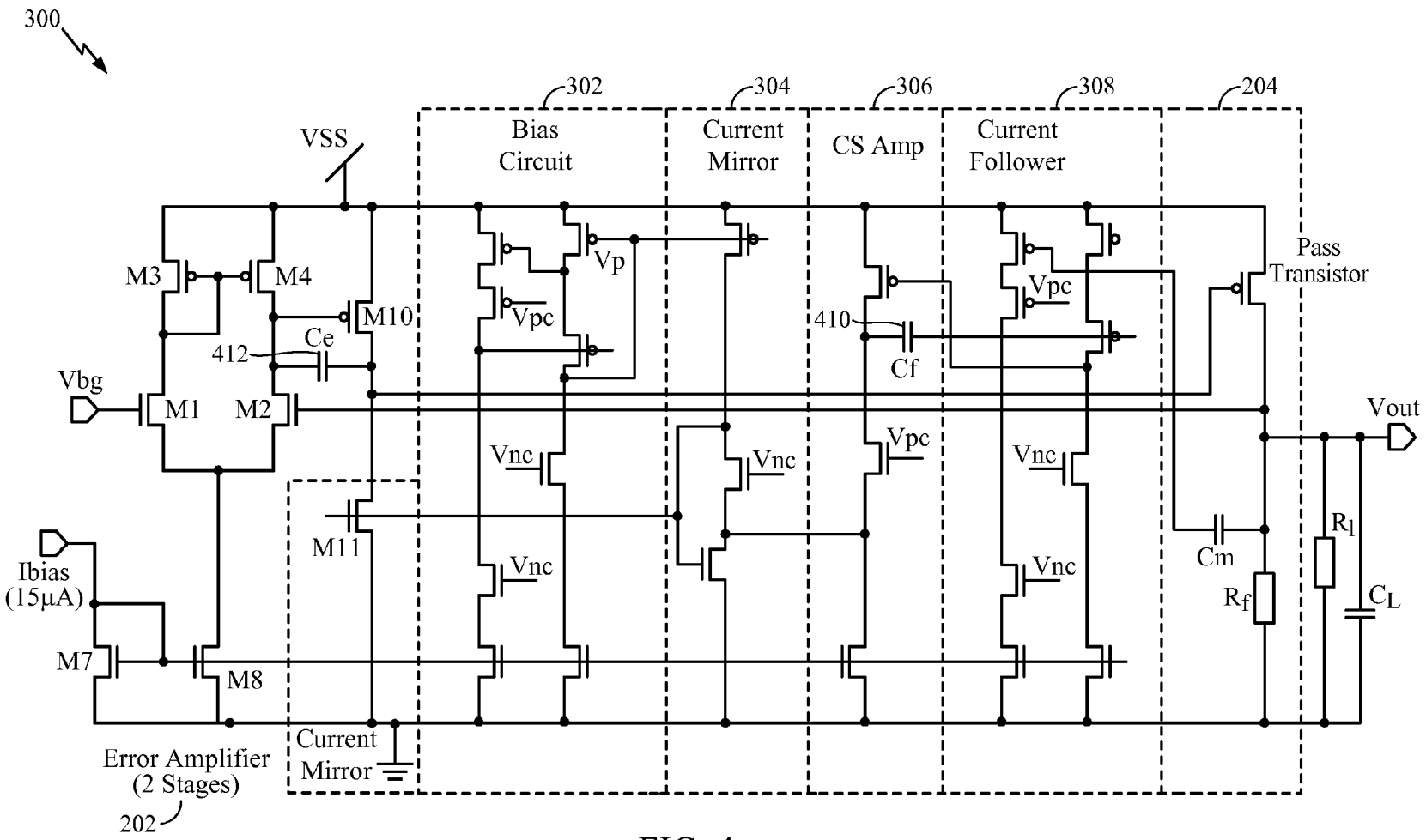
FIG. 4 illustrates a circuit diagram of an exemplary capacitor-less LDO voltage regulator implementing positive feedback to control Quality factor Q.

Referring now to FIG. 4, an exemplary circuit implementation of LDO voltage regulator 300 is illustrated. As shown, the circuit of LDO voltage regulator 300 retains several circuit elements of LDO voltage regulator 200, while introducing a few modifications as follows. Firstly, LDO voltage regulator 300 includes CS Amplifier 406 comprising capacitor 410 as shown. Capacitor 410 is introduced in order to create a positive feedback path. Capacitor 410 increases the bandwidth over which gma of LDO voltage regulator 300 is maximized, and consequently, Q is decreased. Accordingly, the peak gain of LDO voltage regulator 300 is maintained at a stable, low value, over a wide range of frequencies by controlling Q.

With continuing reference to FIG. 4, capacitor 412 is included to LDO voltage regulator 300 as a second modification. As illustrated, capacitor 412 is introduced in the pull-up path of output voltage $V_{out}$. As discussed previously, the pull-up path includes transistors M2 and M10. It can be observed that without the introduction of capacitor 412, the pull-up path is much faster than the pull-down path comprising Miller amplifier 206 and transistor M11. Therefore, capacitor 412 is added in order to slow down the pull-up path, and thereby balance the pull-up and pull-down paths. Balancing the pull-up and pull-down paths in this manner can avoid large transient spikes that might otherwise occur in circuits with unbalanced pull-up and pull-down paths.

Thus, exemplary embodiments implement an efficient capacitor-less LDO voltage regulator, for example LDO voltage regulator 200, by merging error amplifier 202 and Miller amplifier 206 at the gate terminal of pass transistor 204. Error amplifier 202 may provide the pull-up path for the output voltage $V_{out}$, and Miller amplifier 206 may provide the pull-down path. Modifications to LDO voltage regulator 200 may comprise structures for balancing pull-up and pull-down paths as described with respect to LDO voltage regulator 300. It will be seen that additional current distribution techniques are not required in exemplary embodiments as described herein. Further, exemplary embodiments also implement a positive feedback technique by which Quality factor Q is controlled in Miller amplifier 206, in order to minimize peak gain across a wide range of frequencies.

Accordingly, exemplary embodiments provide a solution to replace LDO voltage regulators having bulky external capacitors, with a capacitor-less LDO architecture that is robust under low power supply voltage conditions, such as 1.31V. Exemplary embodiments also include compensation schemes that provide a fast transient response and a full range of alternating current (AC) stability for a wide range of load currents, such as 0 uA to 50 mA. In one embodiment designed for 45 nm technology, a 50 mA digital controlled voltage output can range from 0.63V to 1.11V and may consume only about 65 uA of quiescent current and with a dropout voltage of approximately 200 mV.

LDO voltage regulators such as LDO voltage regulator 200 and 300 can be included in a variety of devices such as, a remote unit, and/or a portable computer. For example, the remote units may be mobile phones, hand-held personal communication systems (PCS) units, portable data units such as personal data assistants, GPS enabled devices, navigation devices, set top boxes, music players, video players, entertainment units, fixed location data units such as meter reading equipment, or any other device that stores or retrieves data or computer instructions, or any combination thereof. Embodiments of the disclosure may be suitably employed in any device which includes active integrated circuitry including LDO voltage regulators.

Figure 5:
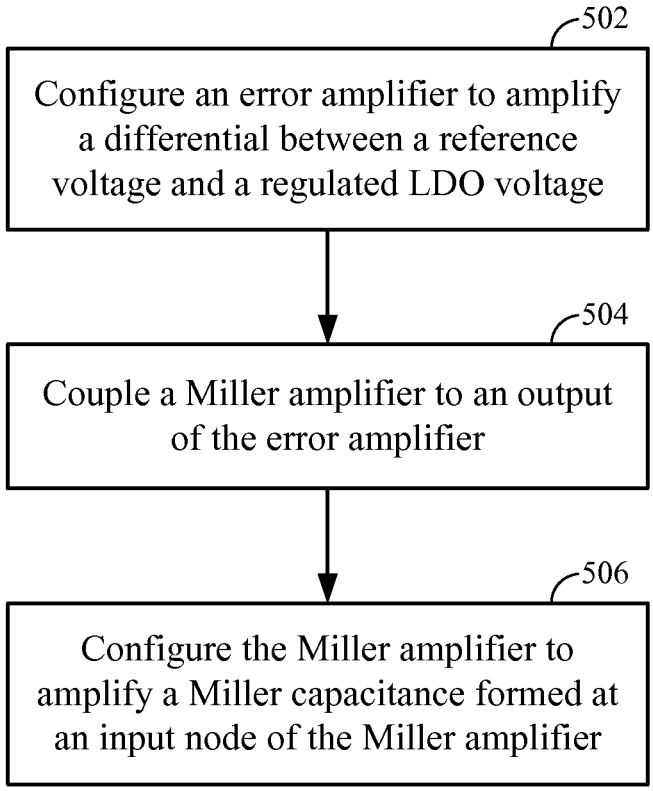
FIG. 5 illustrates a flow-chart representation of a method of forming capacitor-less LDO voltage regulators according to exemplary embodiments.

Further, it will be appreciated that embodiments include various methods for performing the processes, functions and/or algorithms disclosed herein. For example, as illustrated in FIG. 5, an embodiment can include a method of configuring a capacitor-less Low Dropout (LDO) voltage regulator comprising: configuring an error amplifier to amplify a differential between a reference voltage and a regulated LDO voltage (Block 502); coupling a Miller amplifier to an output of the error amplifier (Block 504); and configuring the Miller amplifier to amplify a Miller capacitance formed at an input node of the Miller amplifier (Block 506).

Those of skill in the art will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Further, those of skill in the art will appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The methods, sequences and/or algorithms described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor.

Accordingly, an embodiment of the invention can include a computer readable media embodying a method for efficient implementations of capacitor-less low dropout (LDO) voltage regulators. Accordingly, the invention is not limited to illustrated examples and any means for performing the functionality described herein are included in embodiments of the invention.

Figure 6:
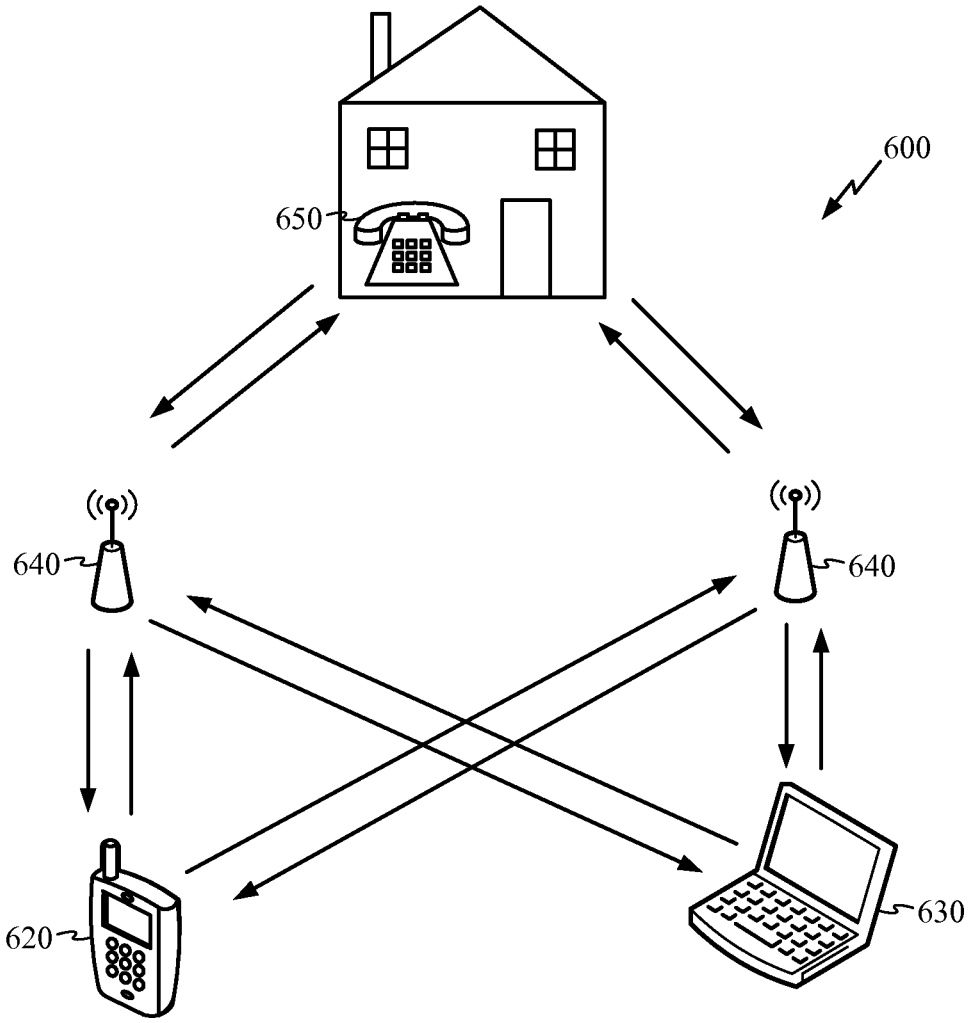
FIG. 6 illustrates an exemplary wireless communication system in which an embodiment of the disclosure may be advantageously employed.

FIG. 6 illustrates an exemplary wireless communication system 600 in which an embodiment of the disclosure may be advantageously employed. For purposes of illustration, FIG. 6 shows three remote units 620, 630, and 650 and two base stations 640. In FIG. 6, remote unit 620 is shown as a mobile telephone, remote unit 630 is shown as a portable computer, and remote unit 650 is shown as a fixed location remote unit in a wireless local loop system. For example, the remote units may be mobile phones, hand-held personal communication systems (PCS) units, portable data units such as personal data assistants, GPS enabled devices, navigation devices, settop boxes, music players, video players, entertainment units, fixed location data units such as meter reading equipment, or any other device that stores or retrieves data or computer instructions, or any combination thereof. Although FIG. 6 illustrates remote units according to the teachings of the disclosure, the disclosure is not limited to these exemplary illustrated units. Embodiments of the disclosure may be suitably employed in any device which includes active integrated circuitry including memory and on-chip circuitry for test and characterization.

The foregoing disclosed devices and methods are typically designed and are configured into GDSII and GERBER computer files, stored on a computer readable media. These files are in turn provided to fabrication handlers who fabricate devices based on these files. The resulting products are semiconductor wafers that are then cut into semiconductor die and packaged into a semiconductor chip. The chips are then employed in devices described above.

While the foregoing disclosure shows illustrative embodiments of the invention, it should be noted that various changes and modifications could be made herein without departing from the scope of the invention as defined by the appended claims. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

What is claimed is:

1. A capacitor-less Low Dropout (LDO) voltage regulator comprising:

an error amplifier configured to amplify a differential between a reference voltage and a regulated LDO voltage; and an output node of a Miller amplifier coupled to an output of the error amplifier, wherein the Miller amplifier is configured to amplify a Miller capacitance formed at an input node of the Miller amplifier.

2. The capacitor-less LDO voltage regulator of claim 1, further comprising a pass transistor, wherein the output of the error amplifier is coupled to a gate node of the pass transistor, and the regulated LDO voltage is derived at an output node of the pass transistor.

3. The capacitor-less LDO voltage regulator of claim 1, wherein the error amplifier is configured to provide a pull-up path for the regulated LDO voltage, and the Miller capacitance is configured to provide a pull-down path for the regulated LDO voltage.

4. The capacitor-less LDO voltage regulator of claim 1, further comprising a first capacitor coupled to the output of the error amplifier, such that the first capacitor creates a positive feedback loop for decreasing a quality factor, wherein the quality factor is directly proportional to a voltage gain of the capacitor-less LDO voltage regulator.

5. The capacitor-less LDO voltage regulator of claim 4, further comprising a second capacitor formed within the Miller amplifier, wherein the second capacitor is configured to balance a pull-up path and pull-down path for the regulated LDO voltage.

6. The capacitor-less LDO voltage regulator of claim 1, wherein the Miller amplifier comprises a current follower, a current source amplifier, and a current mirror.

7. The capacitor-less LDO voltage regulator of claim 1, wherein the error amplifier comprises a pair of cross-coupled inverters.

8. The capacitor-less LDO voltage regulator of claim 1, further comprising an output load coupled to the output node of the pass transistor.

9. The capacitor-less LDO voltage regulator of claim 1, integrated in at least one semiconductor die.

10. The capacitor-less LDO voltage regulator of claim 1, integrated in a device selected from the group consisting of a set top box, music player, video player, entertainment unit, navigation device, communications device, personal digital assistant (PDA), fixed location data unit, and a computer.

11. A method for forming a capacitor-less Low Dropout (LDO) voltage regulator comprising:

configuring an error amplifier to amplify a differential between a reference voltage and a regulated LDO voltage;

coupling an output of a Miller amplifier to an output of the error amplifier; and configuring the Miller amplifier to amplify a Miller capacitance formed at an input node of the Miller amplifier.

12. The method of claim 11, further comprising coupling the output of the error amplifier to a gate node of a pass transistor, and deriving the regulated LDO voltage at an output node of the pass transistor.

13. The method of claim 11, comprising configuring the error amplifier to provide a pull-up path for the regulated LDO voltage, and configuring the Miller capacitance to provide a pull-down path for the regulated LDO voltage.

14. The method of claim 11, further comprising coupling a first capacitor to the output of the error amplifier, such that the first capacitor creates a positive feedback loop for decreasing a quality factor, wherein the quality factor is directly proportional to a voltage gain of the capacitor-less LDO voltage regulator.

15. The method of claim 14, further comprising configuring a second capacitor within the Miller amplifier, such that a pull-up path is balanced with a pull-down path for the regulated LDO voltage.

16. The method of claim 11, comprising forming the Miller amplifier from a current follower, a current source amplifier, and a current mirror.

17. The method of claim 11, further comprising forming an output load at the output node of the pass transistor.

18. A method for forming a capacitor-less Low Dropout (LDO) voltage regulator comprising:

step for configuring an error amplifier to amplify a differential between a reference voltage and a regulated LDO voltage;

step for coupling an output of a Miller amplifier to an output of the error amplifier; and step for configuring the Miller amplifier to amplify a Miller capacitance formed at an input node of the Miller amplifier.

19. The method of claim 18, further comprising step for coupling the output of the error amplifier to a gate node of a pass transistor, and step for deriving the regulated LDO voltage at an output node of the pass transistor.

20. The method of claim 18, comprising step for configuring the error amplifier to provide a pull-up path for the regulated LDO voltage, and step for configuring the Miller capacitance to provide a pull-down path for the regulated LDO voltage.

21. The method of claim 18, further comprising step for coupling a first capacitor to the output of the error amplifier, such that the first capacitor creates a positive feedback loop for decreasing a quality factor, wherein the quality factor is directly proportional to a voltage gain of the capacitor-less LDO voltage regulator.

22. The method of claim 21, further comprising step for configuring a second capacitor within the Miller amplifier, such that a pull-up path is balanced with a pull-down path for the regulated LDO voltage.

23. The method of claim 18, comprising step for forming the Miller amplifier from a current follower, a current source amplifier, and a current mirror.

24. The method of claim 18, further comprising step for forming an output load at the output node of the pass transistor.

25. A system comprising:

a capacitor-less Low Dropout (LDO) voltage regulator comprising:

an amplifier means to amplify a differential between a reference voltage and a regulated LDO voltage; and an output of a Miller amplifier coupled to an output of the amplifier means, wherein the Miller amplifier is configured to amplify a Miller capacitance formed at an input node of the Miller amplifier.

26. The system of claim 25, further comprising means for coupling the output of the amplifier means to an input node of a switching means, and means for deriving the regulated LDO voltage at an output node of the switching means.

27. The system of claim 25, comprising means for configuring the amplifier means to provide a pull-up path for the regulated LDO voltage, and means for configuring the Miller capacitance to provide a pull-down path for the regulated LDO voltage.

28. The system of claim 25, further comprising means for decreasing a quality factor, wherein the quality factor is directly proportional to a voltage gain of the capacitor-less LDO voltage regulator.

29. The system of claim 28, further comprising means balancing a pull-up path with a pull-down path for the regulated LDO voltage.

30. The system of claim 25, further comprising means for forming an output load at the output node of the switching means.

31. The system of claim 25, integrated in at least one semiconductor die.

32. The system of claim 25, integrated in a device selected from the group consisting of a set top box, music player, video player, entertainment unit, navigation device, communications device, personal digital assistant (PDA), fixed location data unit, and a computer.

* * * * *